US011618614B2

(12) United States Patent
Otsuka et al.

(10) Patent No.: US 11,618,614 B2
(45) Date of Patent: Apr. 4, 2023

(54) AIRTIGHT CONTAINER

(71) Applicant: YOSHIDA INDUSTRIES CO., LTD., Tokyo (JP)

(72) Inventors: Noritaka Otsuka, Tokyo (JP); Tsutomu Hidaka, Tokyo (JP)

(73) Assignee: YOSHIDA INDUSTRIES CO., LTD., Tokyo (JP)

( * ) Notice: Subject to any disclaimer, the term of this patent is extended or adjusted under 35 U.S.C. 154(b) by 0 days.

(21) Appl. No.: 17/502,041

(22) Filed: Oct. 15, 2021

(65) Prior Publication Data

US 2022/0144498 A1 May 12, 2022

(30) Foreign Application Priority Data

Nov. 9, 2020 (JP) ..... JP2020-186440

(51) Int. Cl.

| | |
|---|---|
| ***B65D 53/04*** | (2006.01) |
| ***B65D 41/04*** | (2006.01) |
| ***B65D 1/10*** | (2006.01) |
| ***A45D 40/00*** | (2006.01) |

(52) U.S. Cl.

CPC ..... *B65D 41/045* (2013.01); *A45D 40/0068* (2013.01); *B65D 1/10* (2013.01)

(58) Field of Classification Search

CPC ..... B65D 41/045; B65D 41/0435; B65D 41/0457; B65D 41/0464; B65D 41/225; B65D 41/205; B65D 41/30; B65D 41/325; B65D 41/60; A45D 2200/051

USPC ..... 215/44

See application file for complete search history.

(56) References Cited

U.S. PATENT DOCUMENTS 2,206,118 A * 7/1940 Pahls ..... B65D 47/42 215/354
2,989,208 A * 6/1961 Gibbs, Jr. ..... B65D 15/06 220/254.2
4,308,965 A * 1/1982 Dutt ..... B65D 41/0442 215/DIG. 1

(Continued)

FOREIGN PATENT DOCUMENTS

JP S57-101767 U 6/1982
JP S58-125156 U 8/1983

(Continued)

*Primary Examiner* — Ernesto A Grano
*Assistant Examiner* — Symren K Sanghera
(74) *Attorney, Agent, or Firm* — Isshiki & Partners; Joseph P. Farrar, Esq.

(57) ABSTRACT

An airtight container including a container body having a neck with an opening at one end, a cap having inside a portion having a convex lower end side and attaches to the neck, and a packing. A vertical cross-section of a mouth of the opening forms an upwardly convex curve. The packing has a first concave portion formed on the outer rim of the upper surface, a second concave portion formed on the lower surface sharing a bottom with the first concave portion, and a bent portion radially outboard of the center of the packing and radially inboard of the first and second concave portions are formed, to generate stress that widens the first concave portion and narrows the second concave portion when the cap is attached and the inner surface of the second concave portion is contacted against the mouth of the opening of the neck.

5 Claims, 12 Drawing Sheets

(56) References Cited

U.S. PATENT DOCUMENTS

| | | | | | |
|---|---|---|---|---|---|
| 4,331,249 | A * | 5/1982 | Banich, Sr. | B65D 41/0442 | 215/343 |
| 4,709,825 | A * | 12/1987 | Mumford | B65D 41/0457 | 215/334 |
| 5,297,688 | A * | 3/1994 | Beck | B65D 41/0421 | 215/354 |
| 5,791,506 | A * | 8/1998 | Sheffler | B65D 43/0231 | 220/255 |
| 6,164,503 | A * | 12/2000 | Forsyth | B65D 51/20 | 222/153.05 |
| 7,690,527 | B2 * | 4/2010 | Englund | F16J 15/025 | 277/647 |
| 2008/0067142 | A1 * | 3/2008 | Druitt | B65D 41/04 | 215/324 |
| 2019/0144169 | A1 * | 5/2019 | Byron | B65D 41/0457 | 215/316 |

FOREIGN PATENT DOCUMENTS

| | | | |
|---|---|---|---|
| JP | S59-060158 | U | 4/1984 |
| JP | S60-035056 | U | 3/1985 |

* cited by examiner

AIRTIGHT CONTAINER

CROSS-REFERENCE TO RELATED APPLICATION

This application claims priority pursuant to 35 USC § 119 from Japanese Patent Application No. 2020-186440, filed on Nov. 9, 2020, the entire contents of which are incorporated herein by reference.

BACKGROUND

Technical Field

The present disclosure relates to an airtight container.

Related Art

A conventional airtight container comprises a container body in which the contents are stored and a cap that seals the opening of the container body via a packing. The airtight container has a cylindrical neck to which the cap is attached, and the top of the neck is open.

In case that the longitudinal axis of the cylindrical neck is set to the vertical direction, and an opening that connects to the storage space of the contents is provided in the top of the neck, then with some airtight containers the shape of the cross-section of the open end of the neck when the neck is cut along a plane that includes the longitudinal axis has an upwardly convex curve. There exist packings for sealing the opening of this type of airtight container (i.e., packings for sealing cans, packings for re-sealable lids) and caps with the packing attached (re-sealable lids, re-sealable lid devices). These conventional packings are disk-shaped, with a concave portion formed around the underside of the disk that is shaped to fit the contour of the curved surface of the open end of the neck. When the cap is attached, the inner surface of this concave portion is configured to fit snugly around the open end.

SUMMARY

Airtightness is required of all airtight containers, such that, when the cap is attached, the contents should not leak if the container is dropped, etc. In the conventional airtight containers, airtightness is ensured by pressing the packing downward when the cap is attached and fitting the concave portion formed in the underside of the packing around the open end of the neck. Further, with some packings an upwardly open concave portion is formed in the top surface of the packing as well in order to increase the downward pressing force.

However, with the conventional airtight container, it may not be possible to maintain sufficient air pressure inside the container body in a reduced-pressure environment such as high elevations or in the cargo compartment of an aircraft. To ensure airtightness under these conditions, it is possible to make the cap attachment structure more complicated or use a larger number of parts, but doing so makes it difficult to provide an airtight container at low cost. Further, such caps are so-called "crown caps", in which the open end of the container body to which the cap is attached (hereinafter sometimes referred to as the "mouth") is limited to the B-type base specified by JIS Z 1607 industrial standard. However, given the wide variety of cap attachment structures, an airtight container versatile enough to support such a wide variety of cap attachment structures is also required.

Therefore, present disclosure has as its objective to provide an airtight container that has an uncomplicated structure and can accommodate a wide variety of cap attachment structures while ensuring superior airtightness.

To achieve the above-described objective, one aspect of the present disclosure provides an airtight container having a container body provided with a cylindrical neck having an opening at one end, a cap that is removably attachable to the neck, and a packing that seals the opening. With the longitudinal axis of the cylindrical neck as the vertical direction, the opening opens upward. In a vertical cross-section along a plane including the vertical direction, a mouth of the opening is a curved line that is upwardly convex. The packing has a flattened planar shape with irregular surfaces on both sides, with a groove-shaped first concave portion coaxial with the longitudinal axis formed in the upper surface of the outer rim of the packing, a groove-shaped second concave portion coaxial with the longitudinal axis formed in the lower surface of the outer rim of the packing that shares a bottom with the first concave portion, and a bent portion bent in a groove shape with a bottom toward the bottom formed at an position radially outboard of the center of the packing and radially inboard of an area where the surface the first concave portion and the second concave portion are formed. An outer edge of the bent portion and an inner edge of the first concave portion share a shared side wall, and the shared side wall has a top that is continuous with a side wall on the inner edge of the first concave portion and generates stress that widens the first concave portion to generate stress that narrows the second concave portion. An inside of the cap has a portion formed therein having a convex shape on a lower end side thereof and disposed coaxial with the longitudinal axis, with the lower end side thereof being formed in a shape of decreasing width toward a tip thereof. When the cap is attached to the neck in a state in which the inner surface of the second concave portion is contacted against the mouth of the opening of the neck, the portion having a convex shape on a lower end side thereof is inserted into the first concave portion and widens the first concave portion.

The cap may be configured by a hollow cylindrical cap body that opens downward and a pressing member that is circular or annular in planar shape disposed within the cap body and arranged with the cylindrical axis direction as its normal, and the pressing member has a protruding circumferential lip having a convex shape on a lower end side around the lower rim thereof. Alternatively, the cap may be configured by a hollow cylindrical cap body that opens downward and a pressing member that is annular in planar shape disposed within the cap body and arranged with the cylindrical axis direction as its normal, with the pressing member having a lower end side that is convex in vertical cross-sectional shape along a plane including the vertical direction.

Further, the cap body can be provided with a tubular protrusion that depends vertically downward from the inside top surface of the cap body, such that the lower end of the tubular protrusion abuts on the upper surface of the pressing member while the cap is attached and presses the pressing member downward.

Preferably, the neck is cylindrical, and the opening, the circumferential protrusion, and the packing have a circular planar shape when viewed from along the vertical direction. More preferably, the cap is a screw-type cap that screws onto a male screw thread formed on the outside of the neck.

EFFECT OF THE DISCLOSURE

According to the present disclosure, an airtight container having an uncomplicated structure and is capable of accommodating a wide variety of cap attachment structures while ensuring superior airtightness is provided. Other effects and advantages will become clear from the description that follows.

DETAILED DESCRIPTION

Figure 1A:
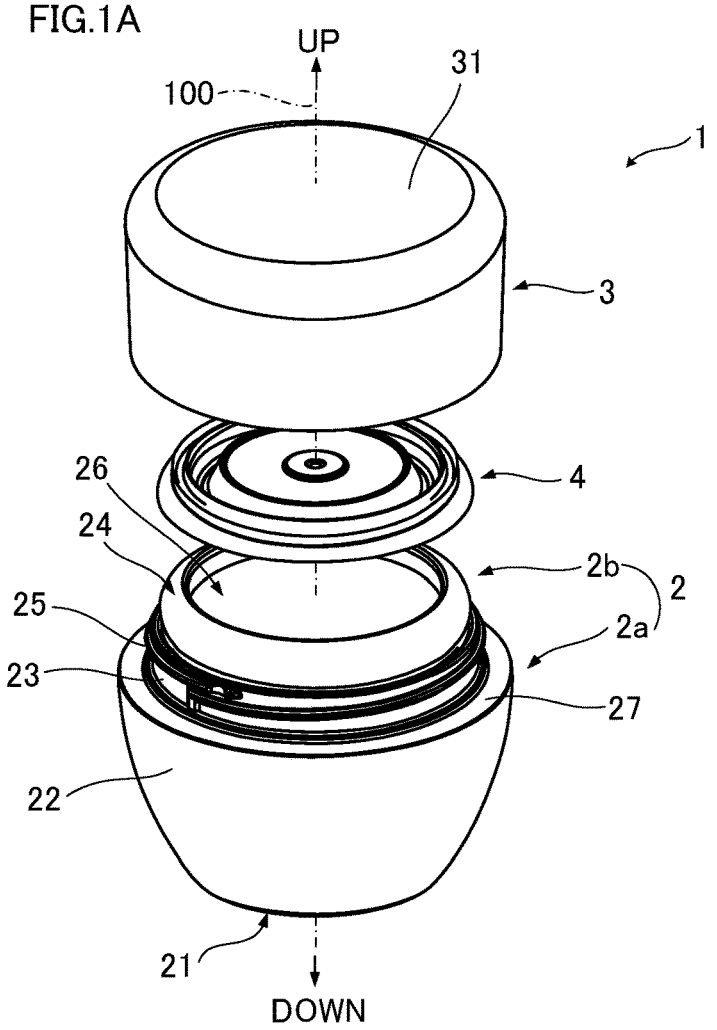
FIG. 1A is a perspective view illustrating the appearance of the airtight container according to an embodiment of the present disclosure, with a cap and a packing that are constituent parts of the airtight container removed.

An embodiment of the present disclosure will now be described with reference to the accompanying drawings, in which the same or similar parts are designated by the same reference numerals and duplicate description thereof omitted. Parts designated with reference numerals in one drawing may be left undesignated in other drawings if such parts are not essential to the explanation.

Figure 1B:
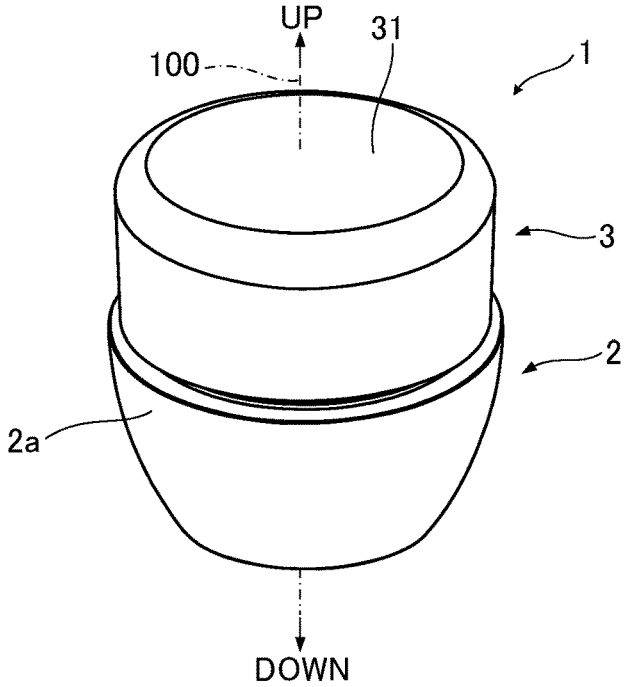
FIG. 1B is a perspective view illustrating the appearance of the airtight container with the cap attached.

FIGS. 1A, 1B are external views of an airtight container (hereinafter also referred to as simply "the container 1") according to an embodiment of the present disclosure. In particular, FIG. 1A illustrates the container 1 in a state in which a cap 3 is detached from a container body 2, whereas FIG. 1B illustrates the container 1 in a state in which the cap 3 is attached to the container body 2. As shown in FIG. 1A, the container 1 has a container body 2 in which the contents are stored, a bottomed cylindrical cap 3 whose bottom is a top surface 31, and a disk-shaped packing 4.

Cosmetics, for example, may be contained inside the container body 2. The container body 2 is composed of an exterior case 2*a* and a cup member 2*b* contained within the exterior case 2*a* and which is the storage part that actually stores the contents. The exterior case 2*a* has a structure consisting of a bowl-shaped body portion 22 whose diameter gradually decreases toward a bottom portion 21 and a cylindrical neck 23 of reduced diameter with respect to the body portion 22, formed as a single integrated unit with the body portion 22 via a shoulder 27, so that the body 22 and the neck 23 are coaxial. Taking the longitudinal axis 100 of the neck 23 (hereinafter also referred to as "the cylindrical axis 100" or simply "the axis 100") as the vertical direction, the container body 2 is open upward, the upper end of the cup member 2*b* protrudes above the upper end of the neck 23, and the upper edge of the area protruding above the neck 23 is the mouth 24 of the container body 2.

The cap 3 of the container 1 according to the embodiment is a so-called screw-type cap, in which a male screw thread 25 is formed around the outside of the neck 23 and a female screw thread 33 that engages this male screw thread 25 is formed around the inside surface of the cap 3. As shown in FIG. 1B, when the cap 3 is screwed onto the neck 23, the cap 3 is attached to the container body 2 and the mouth 24 fits snugly against the bottom edge of the packing 4, thus sealing the container body 2. The container 1 according to the embodiment is characterized by the structure of the cap 3 and the packing 4, which ensures superior airtightness when the cap 3 is attached.

Configuration of the Airtight Container

Figure 2:
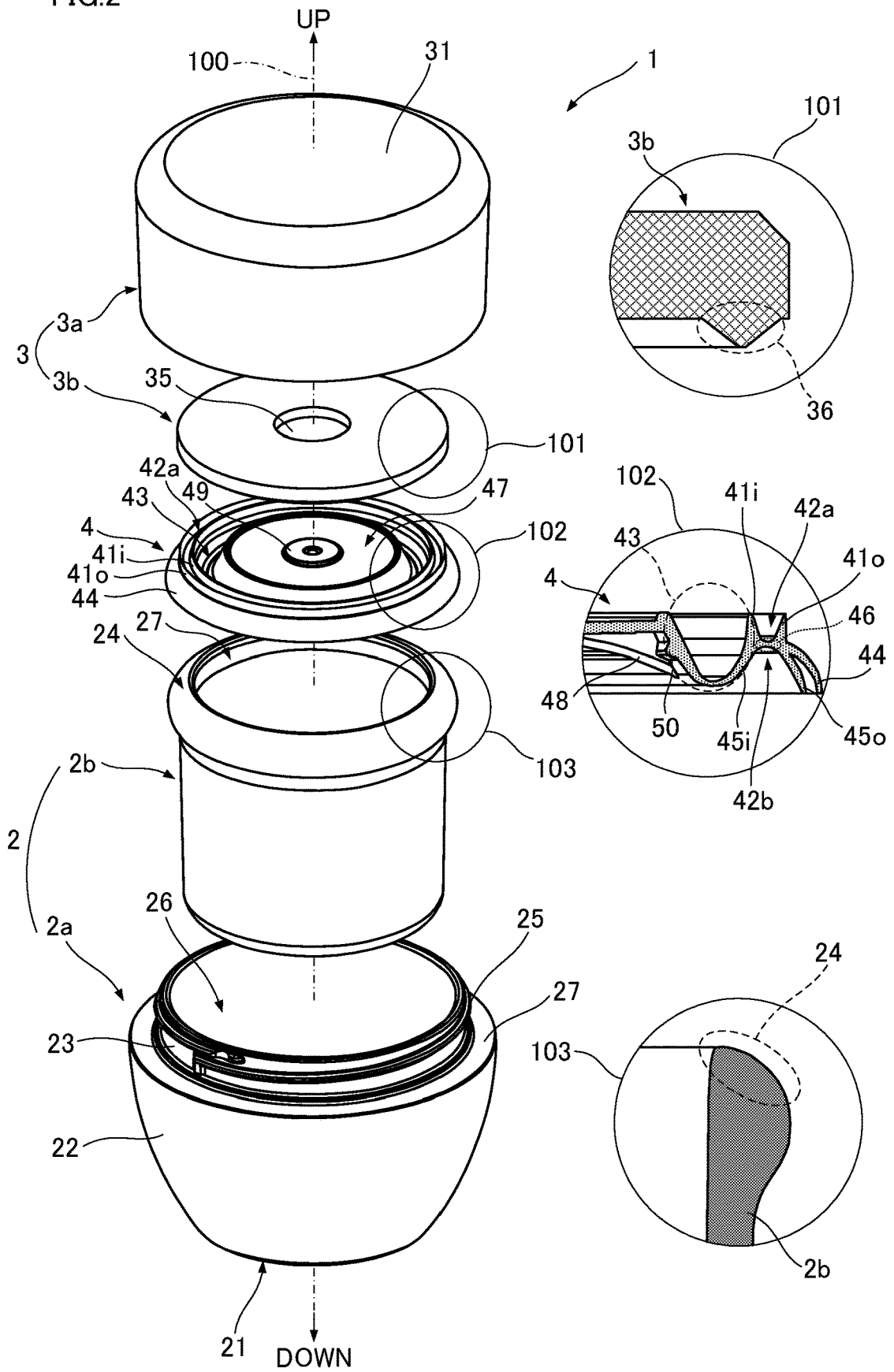
FIG. 2 is an exploded perspective view illustrating the configuration of the airtight container, as viewed from above.
Figure 3:
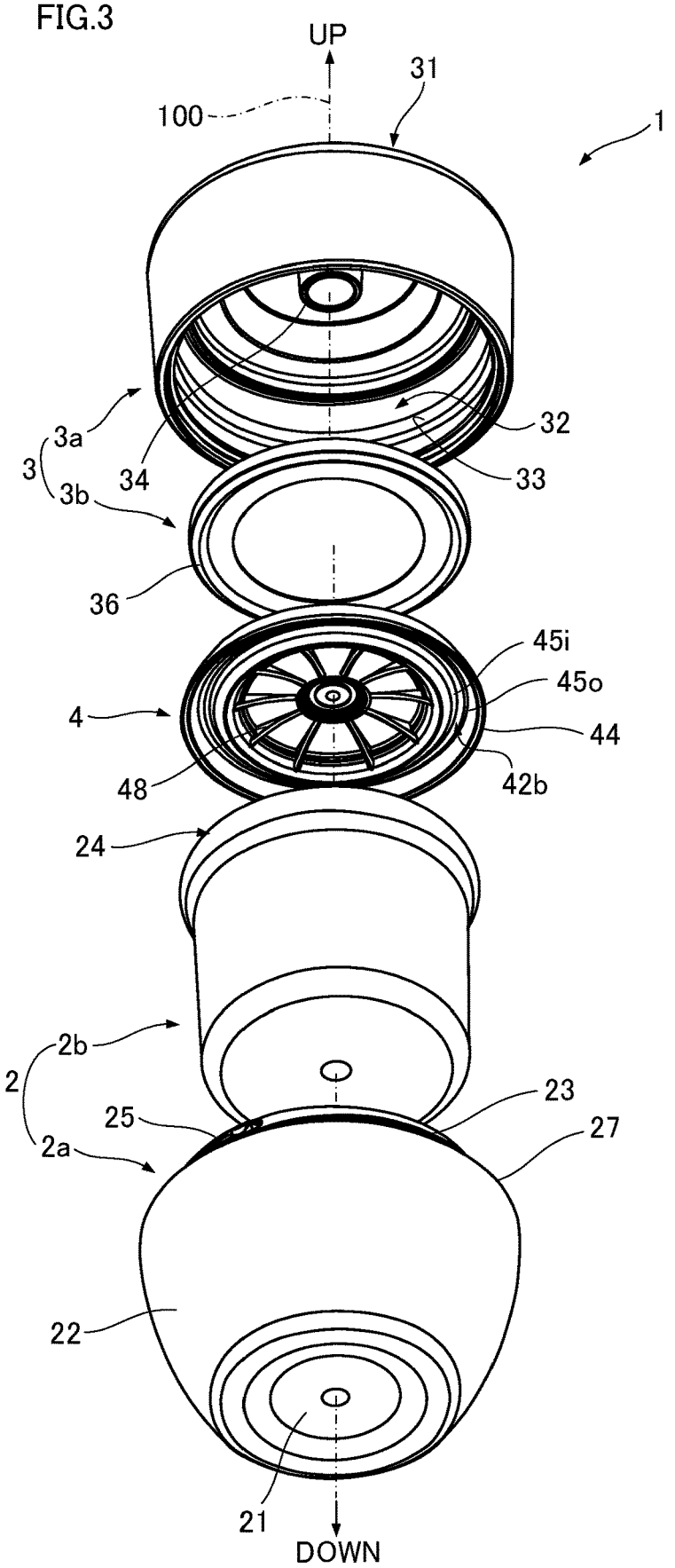
FIG. 3 is an exploded perspective view illustrating the configuration of the airtight container, as viewed from below.

FIGS. 2 and 3 are exploded perspective views illustrating the configuration of the container 1, with FIG. 2 being a perspective view of the container 1 as viewed from above and FIG. 3 is a perspective view of the container 1 as viewed from below. In FIGS. 2 and 3 the container body 2 and cap 3 are shown in an exploded perspective view. In addition, FIG. 2 also provides enlarged views of parts of the container 1 corresponding to the circled areas (101, 102, and 103). In the enlarged views of each of these parts, the vertical cross-section of the container 1 along a plane including the axis 100 is shown.

As shown in FIGS. 2 and 3, the container body 2 is composed of an exterior case 2*a* and a cup member 2*b*. The exterior case 2*a* and the cup member 2*b* are molded products made of a hard plastic, such as polyketone (POK), polyoxymethylene (POM), ABS, polyethylene (PE), polypropylene (PP), polyethylene terephthalate (PET), acrylonitrile styrene (AS), or polymethyl methacrylate (PMMA). The exterior case 2*a* has a cylindrical space 26 that maintains the shape of the opening of the neck 23 and is continuous with the interior of the body portion 22 of the case 2*a*. The container body 2 is configured by accommodating the cup member 2*b* in this space 26. It is to be noted that the cup member 2*b* may be configured so as to be either detachable from the exterior case 2*a* or fixedly mounted to the exterior case 2*a* once it is attached thereto.

The cup member 2*b* is a hollow cylinder with a bottom, with the area on the upper end side expanding radially outward so as to form, a thickened rim. The lower end side of this thickened rim abuts on the upper end surface of the neck 23. As a result, when the cup member 2*b* is accommodated within the exterior case 2*a*, the upper end side of the above-described thickened rim of the cup member 2*b* protrudes above the top of the neck 23 and forms the mouth 24. The mouth 24 has an upwardly convex curved shape. That is, as shown in the enlarged view of area 103 in FIG. 2, the vertical cross-section when along the plane including the axis 100 has an upwardly convex curved shape. Note that the container body 2 need not be composed of an exterior case 2*a* and a cup member 2*b* as described herein. Thus, the interior of the exterior case 2*a* may form the storage space for the contents, and the exterior case 2*a* may be the container body 2. In any case, it suffices if the mouth 24 has an upwardly convex curved shape.

The cap 3 is composed of a bottomed cylindrical cap body 3*a* having a top surface 31 and opening downward, and a disk-shaped pressing member 3*b* coaxially disposed within the cap body 3*a*. The cap body 3*a* and the disk-shaped pressing member 3*b* may be made of a thermoplastic resin such as POK, POM, ABS, PE, PP, PET, AS, polyester or ionomer.

As shown in FIG. 3, a female screw thread 33 that engages the male screw thread 25 of the neck 23 is formed in the inside surface 32 of the cap body 3*a*. A tubular protrusion 34 that depends downward from the center of the bottom of the top surface 31 is formed in the cap body 3*a*. As shown in FIG. 2, a circular concave portion 35 is formed in the center of the upper surface of the disk-shaped pressing member 3*b*. The disk-shaped pressing member 3*b* has a normal axis along the cylindrical axis 100 and is disposed in the cap body 3*a* in a state in which the lower end of the tubular protrusion 34 is in contact with the bottom of the concave portion 35. The disk-shaped pressing member 3*b* may be fixed to the cap body 3*a* by a method such as adhesion or fitting, or it may be detachably attached to the cap body 3*a*.

An annular projection 36, projecting downward and concentric with the axis 100, is formed around the lower rim of the disk-shaped pressing member 3*b*. As can be seen in the vertical cross-section of the annular projection 36 shown in the enlarged view of area 101 in FIG. 2, the annular projection 36 has a triangular shape with its apex at the bottom and widens radially inward and outward at its base toward the top. When the cap 3 is mounted on the neck 23 of the container body 2, the disk-shaped pressing member 3*b* contacts the upper surface of the packing 4 and presses the packing 4 downward. Hereinafter, the disk-shaped pressing member 3*b* is referred to as a pressing member 3*b*, and the annular projection 36 formed around the lower rim of the pressing member 3*b* is referred to as a circumferential lip 36.

Figure 4:
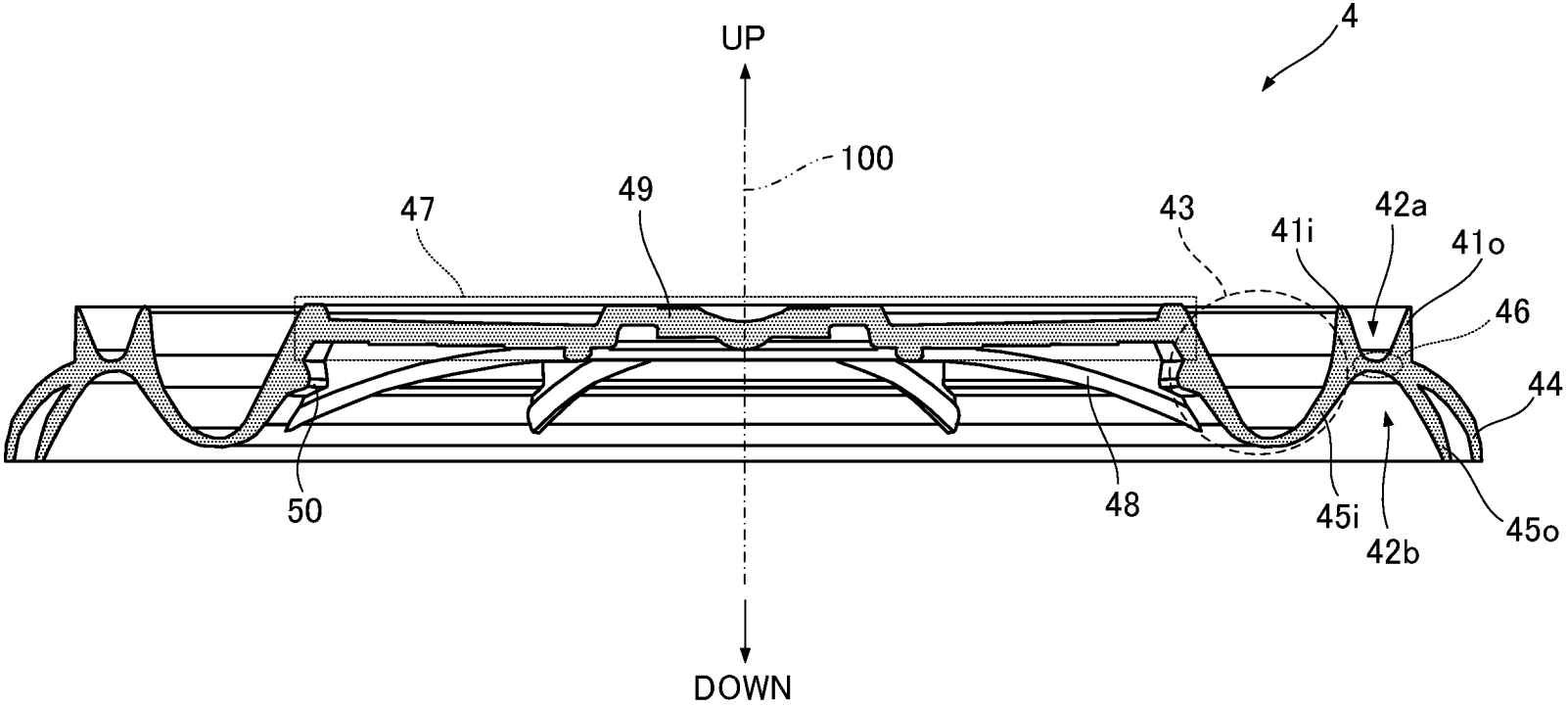
FIG. 4 is a cross-sectional view illustrating the structure of the packing that is a constituent part of the airtight container.

The packing 4 is a unitary molded product made of a flexible material such as polyethylene (PE), polypropylene (PP), polyethylene terephthalate (PET) or other plastic, or an elastic material such as an elastomer, NBR, IIR, natural rubber, fluororubber, etc. FIG. 4 shows a vertical cross-sectional view of the packing 4. As shown in FIGS. 2-4, the packing 4 is a disk with irregular surfaces. As shown in the enlarged view of the area 102 in FIG. 2 and in FIG. 4, two annular protrusions (41*i*, 41*o*) concentric with the axis 100 are formed around the edge of the upper surface of the packing 4. As a result, a U-shaped concave portion 42*a* is formed in the upper surface of the outer edge of the packing 4. Hereinafter, the concave portion 42*a* is referred to as the first concave portion 42*a*, and the protrusions (41*i*, 41*o*) on the inner edge and the outer edge that together form the first concave portion 42*a* are referred to as the upper surface inner protrusion 41*i* and the upper surface outer protrusion 41*o*, respectively.

The packing 4 maintains a generally flat shape radially outward from the center until reaching an area bent sharply into the shape of a U from where the first concave portion 42*a* is formed. Thereafter, heading radially outward further from the area where the first concave portion 42 is formed, an edge portion 44 that bends downward is formed. Further, a protrusion 45*o* that protrudes downward is formed on the lower surface of the packing 4 between the above-described sharply bent area (hereinafter also referred to as the bent portion 43) and the edge portion 44. As a result, an inverted U-shaped concave portion 42*b* that shares a bottom 46 with the first concave portion 42*a* is formed by an outer wall 45*i* of the bent portion 43 and the protrusion 45*o*. In the packing 4 of the container 1 according to the embodiment, the upper end of the wall 45*i* is continuous with the upper surface inner protrusion 41*i*.

Hereinafter, the area from the center of the packing 4 to the bent portion 43 is referred to as flat portion 47, and the inverted U-shaped concave portion 42*b* formed in the bottom of the outer edge of the lower surface of the packing 4 is referred to as the second concave portion 42*b*. The protrusion 45*o* on the outer edge forming the second concave portion 42*b* (together with the outer wall 45*i* of the bent portion 43) is referred to as the lower surface outer protrusion 45*o*, and the wall 45*i* shared by the bent portion 43 and the second concave portion 42*b* is referred to as the shared wall 45*i*.

As shown in FIGS. 2 to 4, the packing 4 is similar to ordinary disk-shaped packing, with concavities and convexities formed in various places for the purpose of reinforcing or dispersing stress when pressed downward. For example, as illustrated in FIG. 3, radiating ribs 48 are formed on the lower surface of the flat portion 47 and an annular convex portion 49 is formed in the center of the upper surface of the flat portion 47. Further, in this embodiment, as shown in the enlarged view of the area 102 in FIG. 2 and in FIG. 4, a thick portion 50 of enhanced thickness protruding radially inward is formed on the inside of the inner wall of the bent portion 43.

Sealing Structure

Figure 5A:
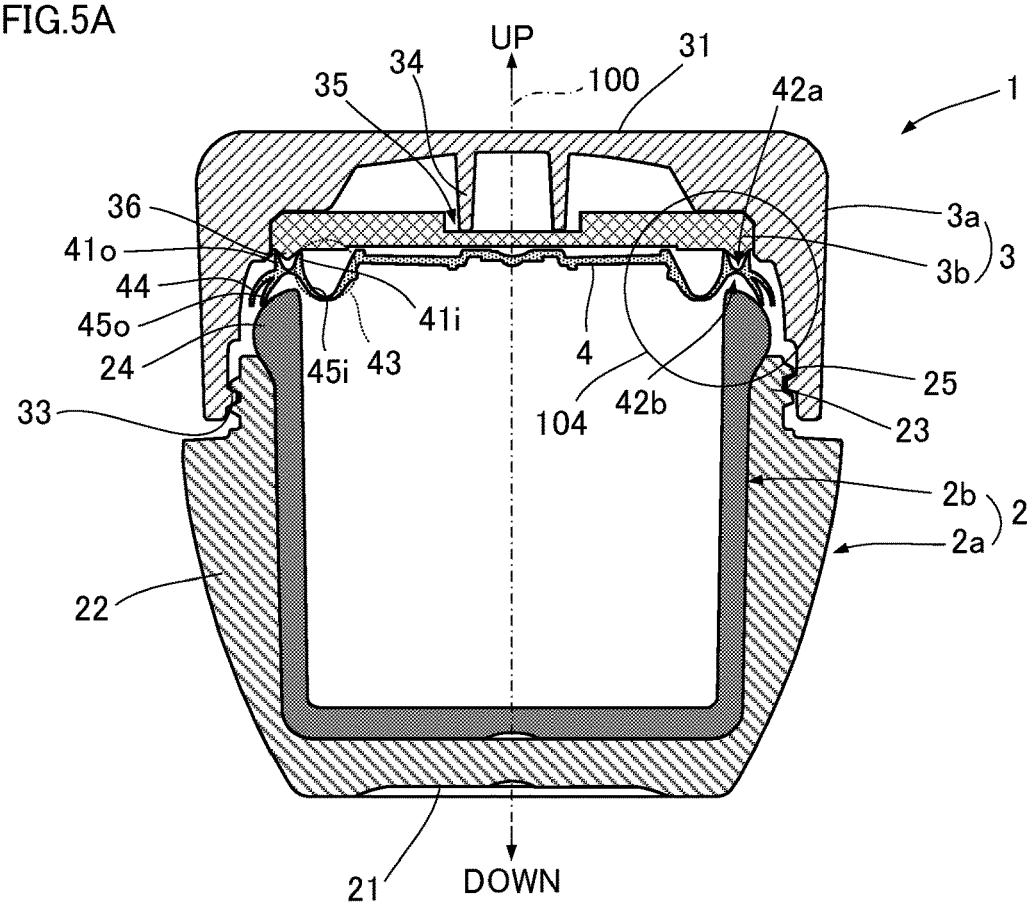
FIG. 5A is a cross-sectional view of the entire airtight container.
Figure 5B:
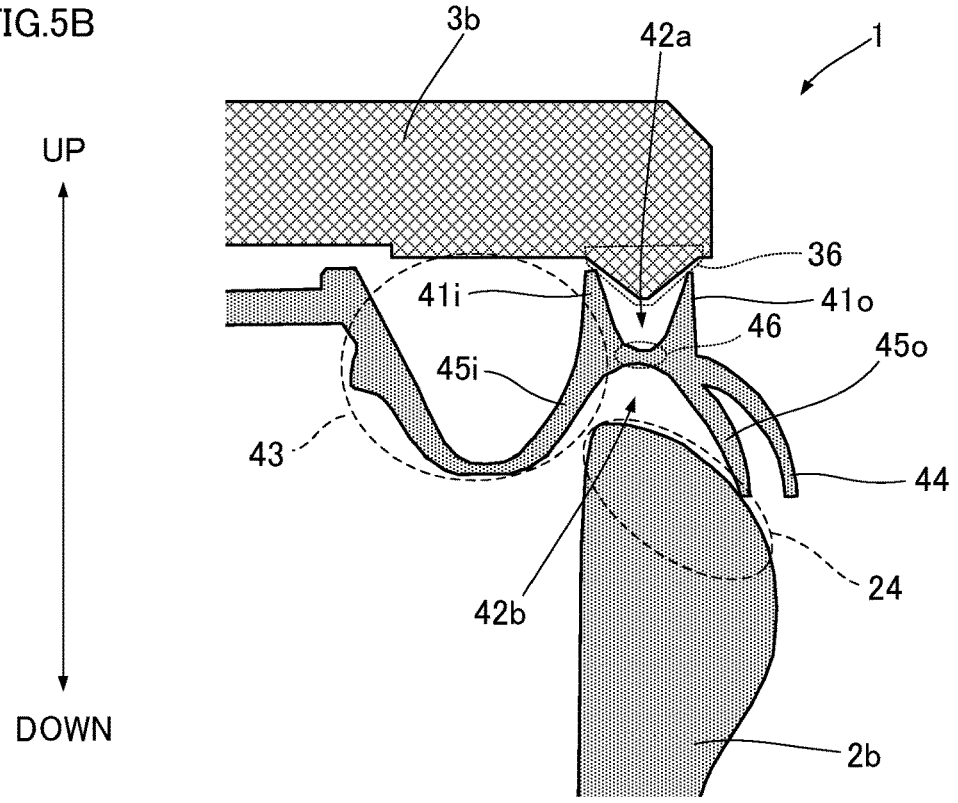
FIG. 5B is a cross-sectional view of a main part of the airtight container.
Figure 6A:
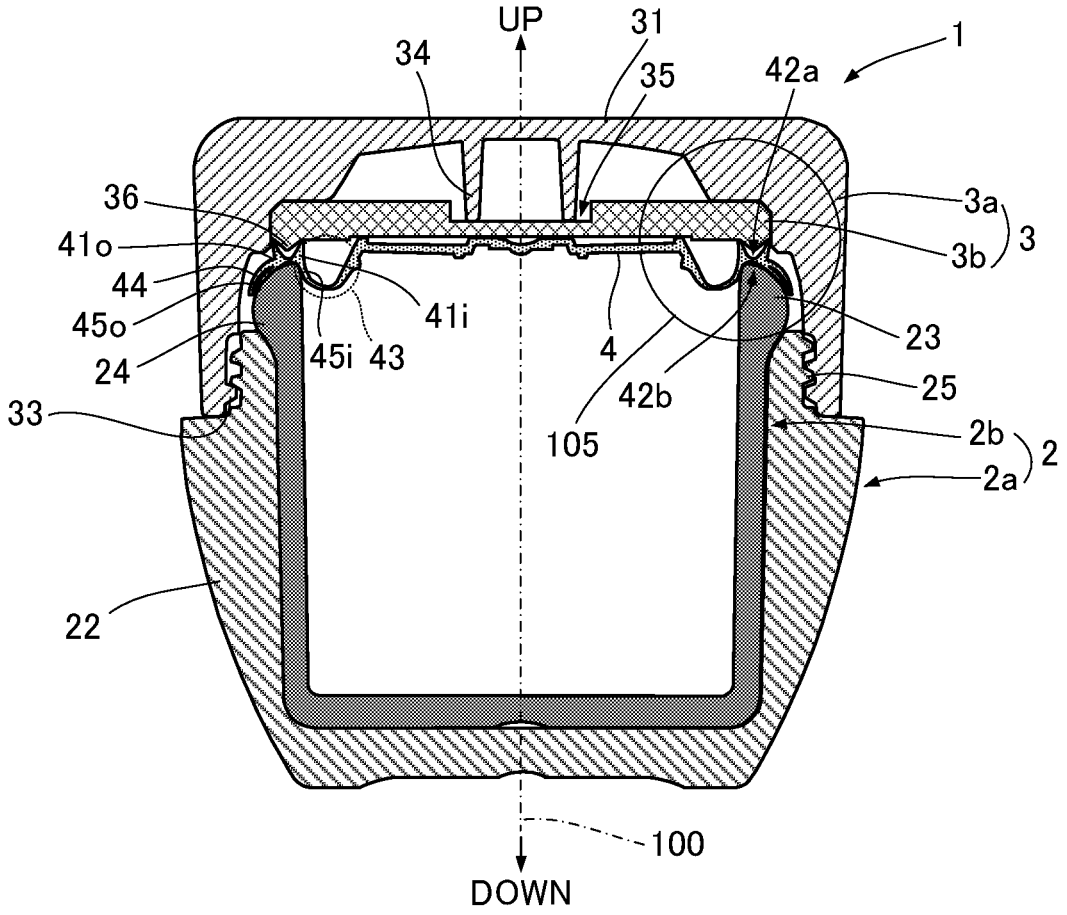
FIG. 6A is a cross-sectional view of the entire airtight container.
Figure 6B:
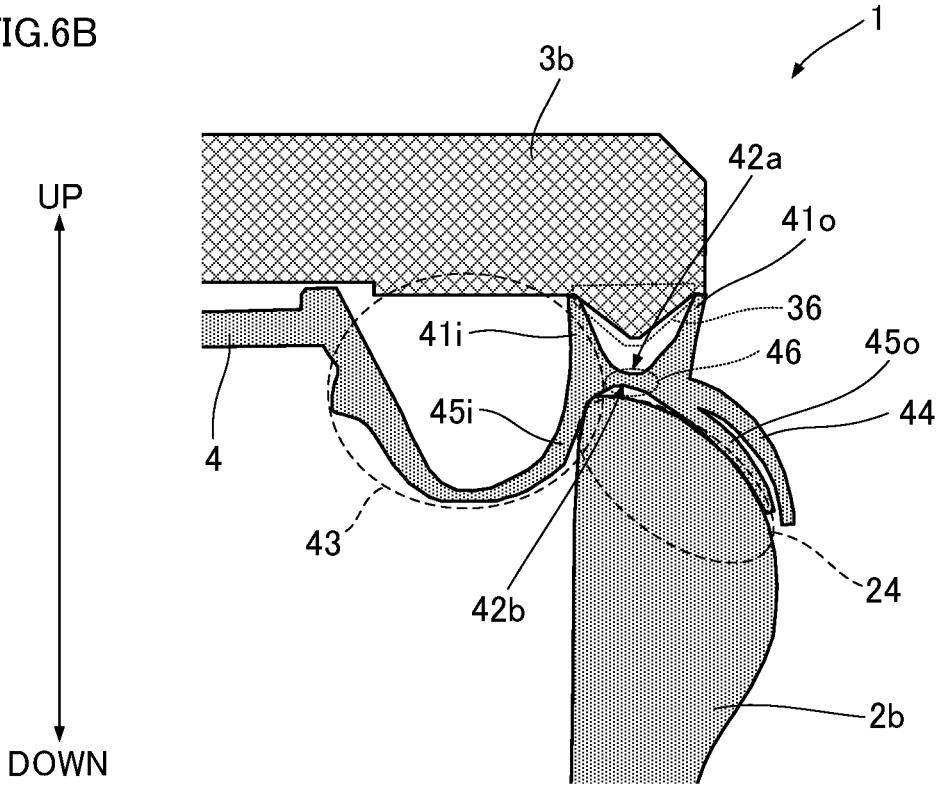
FIG. 6B is a cross-sectional view of a main part of the airtight container.

In the container 1 having the above-described configuration, when the cap 3 is attached to the container body 2, while the second concave portion 42*b* of the packing 4 is contacted against the mouth 24 the cap 3 is screwed onto the neck 23. As a result, the packing 4 is squeezed between the mouth 24 and the pressing member 3*b* to put the container body 2 into an airtight state. FIGS. 5A-6B explain the container sealing structure. FIGS. 5A and 5B are vertical cross-sectional views of the container 1 when the container body 2 is not sealed, and FIGS. 6A, 6B illustrate are vertical cross-sectional view of the container 1 when it is in a sealed state. In addition, FIGS. 5A and 6A are vertical cross-sectional views of the entire container 1, whereas FIGS. 5B and 6B are enlarged views of the area inside the circle 104 in FIG. 5A and the area inside the circle 105 in FIG. 6A, respectively.

As described above, the cap 3 is a screw-type cap, such that, when the cap 3 is attached to the container body 2, as shown in FIG. 5A the packing 4 is placed on the mouth 24 of the cup member 2*b* and the cap 3 covers the neck 23. At this time, the mouth 24 of the cup member 2*b* is opposite the second concave portion 42*b* of the packing 4 and the circumferential lip 36 of the pressing member 3*b* is opposite the first concave portion 42*a* of the packing 4. Note that with the cap 3 just covering the neck 23, the lower end of the cap 3 is separated upward from the shoulder portion 27 of the exterior case 2*a* of the container body 2. Further, as shown in FIG. 5B, the packing 4 is not pressed downward by the pressing member 3*b* but remains placed on the mouth 24 while maintaining its original shape.

Next, as shown in FIG. 6A, once the cap 3 is screwed onto the neck 23 to a predetermined closing position, as shown in FIG. 6B the circumferential lip 36 that widens upward enters the first concave portion 42*a* and pushes apart the upper surface inner protrusion 41*i* and the upper surface outer protrusion 41*o* of the first concave portion 42*a*, thus widening the gap between them while concomitantly forcing the shared wall 45*i* and the lower surface outer protrusion 45*o* closer together. As a result, the second concave portion 42*b* is more firmly attached to the mouth 24 in conjunction with the widening of the first concave portion 42*a* as described above, thereby further enhancing the airtightness of the container body 2.

Figure 7A:
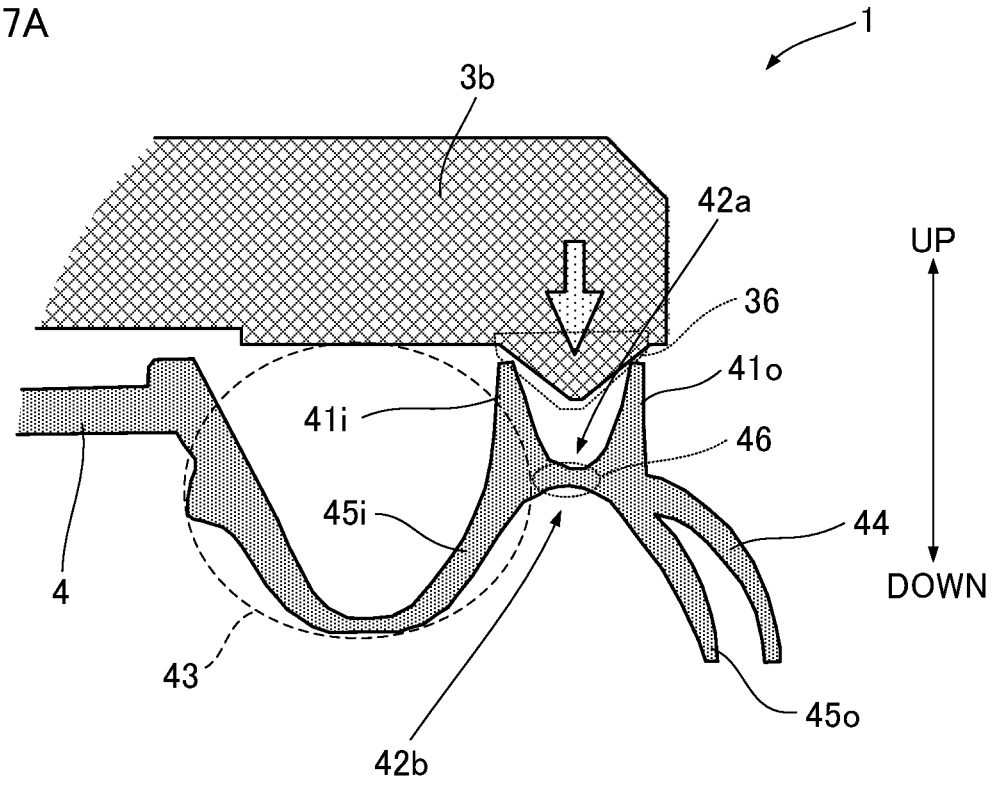
FIGS. 7A, 7B are cross-sectional views illustrating the mechanism of operation of the sealing structure of the present embodiment.
Figure 7B:
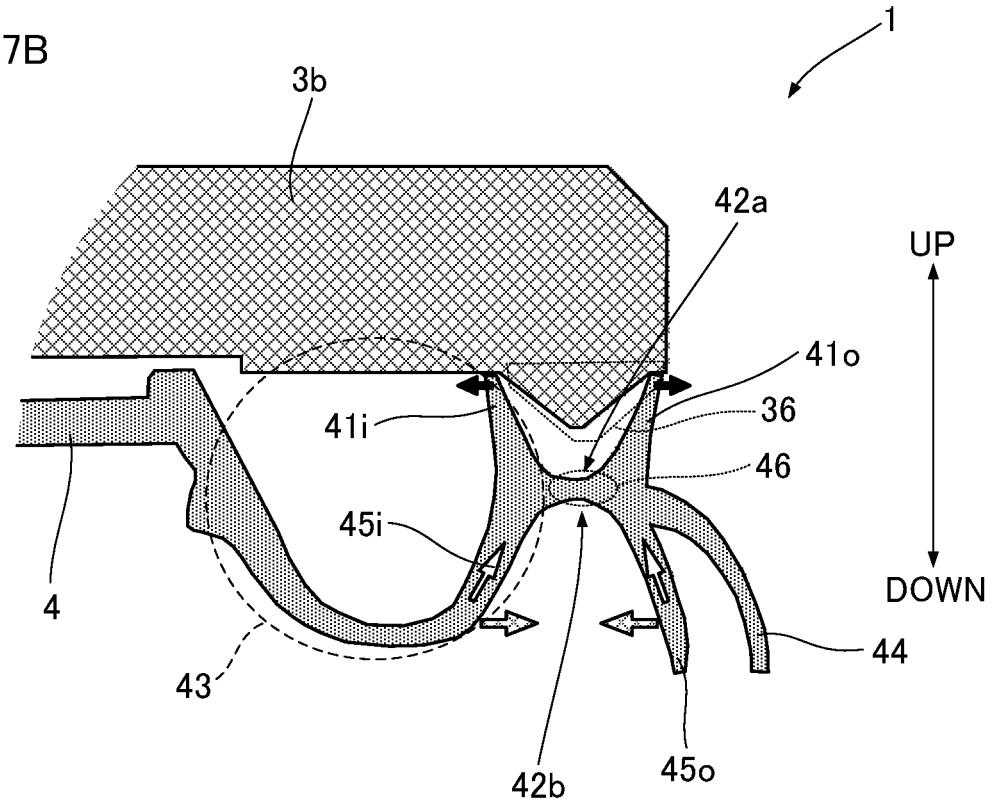

FIGS. 7A, 7B are cross-sectional views illustrating in detail the mechanism of operation of the sealing structure of the container 1. FIGS. 7A, 7B illustrate the relation between the operation of widening the first concave portion 42*a* with the pressing member 3*b* and the operation of more strongly attaching the second concave portion 42*b* to the mouth 24, while omitting for ease of illustration the configuration of the container 1 excluding the pressing member 3*b* and the packing 4. Thus, FIG. 7A shows the shape of the packing 4 before the cap 3 is attached and FIG. 7B shows the deformation of the packing 4 due to attaching the cap 3. As shown in FIG. 7A, in the state before the cap 3 is completely attached, although the circumferential lip 36 of the pressing member 3*b* is inside the first concave portion 42*a* the packing 4 still retains its original shape. In contrast, as shown in FIG. 7B, when the screw-type cap 3 is further screwed onto the neck 23 the circumferential lip 36 is pressed into the first concave portion 42*a* and presses down on the packing 4. The upper end side of the circumferential lip 36 has a width wider than the distance between the upper surface inner protrusion 41*i* and the upper surface outer protrusion 41*o* of the first concave portion 42*a*, such that, as illustrated by the black arrows in FIG. 7B, as the deposited lip 36 presses down on the packing 4 downward it spreads apart the upper surface inner protrusion 41*i* and the upper surface outer protrusion 41*o* of the first concave portion 42*a* by bending them radially inward and outward respectively, so that the first concave portion 42*a* widens.

When the first concave portion 42*a* is widened from its original shape, upward stress is generated in both the walled portion 45*i* and the lower surface outer protrusion 45*o* as illustrated by the white arrows in FIG. 7B, and that stress squeezes the second concave portion 42*b* by pushing the walled portion 45*i* and the lower surface outer protrusion 45*o* closer together as shown by the arrows with hatching in FIG. 7B. At this time, as long as the mouth 24 is in contact with inner surface of the second concave portion 42*b*, the stress that is attempting to deform the second concave portion 42*b* becomes a force that sandwiches the mouth 24 from both radially inside and outside. As a result, the mouth 24 is squeezed by and firmly attaches to the outer surface of the shared wall 45*i* and the inner surface of the lower surface outer protrusion 45*o* of the second concave portion 42*b*, and the airtightness of the container body 2 is enhanced. It is to be noted that, in the container 1 according to the embodiment, the thickness of each part of the packing 4 is adjusted in order to deform the second concave portion 42*b* with the deformation of the first concave portion 42*a*.

Figure 8:
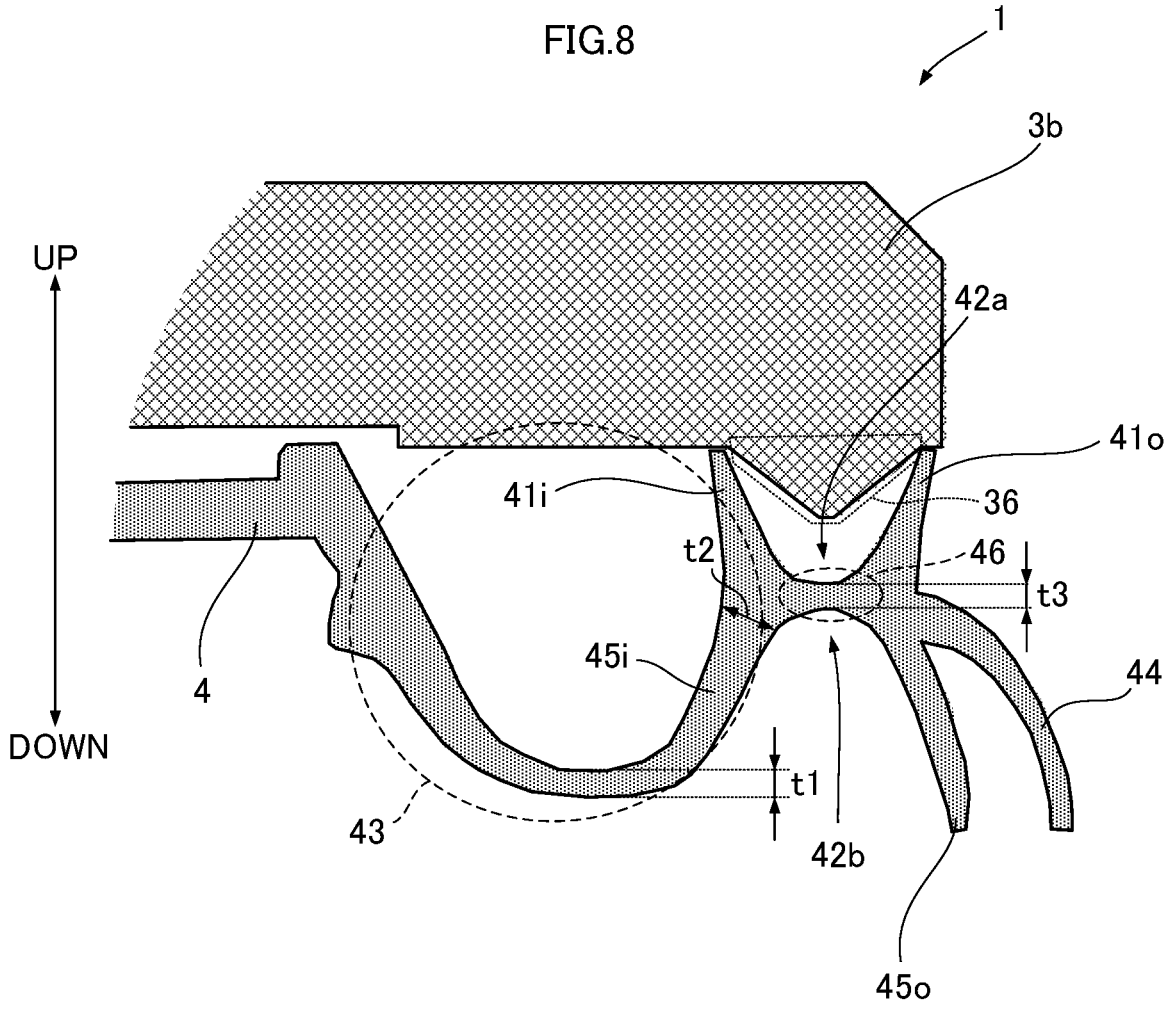
FIG. 8 is a cross-sectional view illustrating a thickness of each portion of the packing.
Figure 9A:
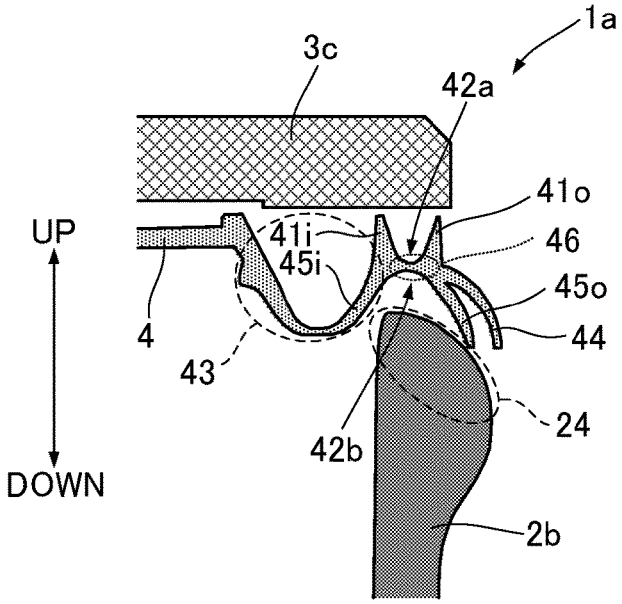
FIGS. 9A, 9B, 9C, 9D are cross-sectional views illustrating sealing structures of airtight containers according to comparative examples.
Figure 9B:
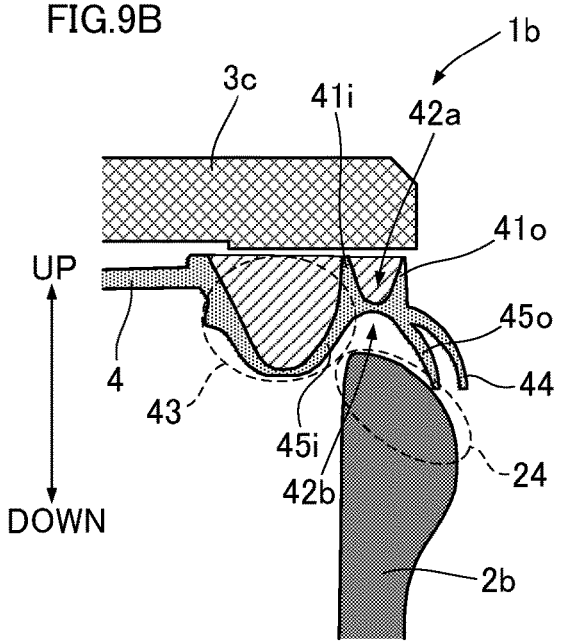
Figure 9C:
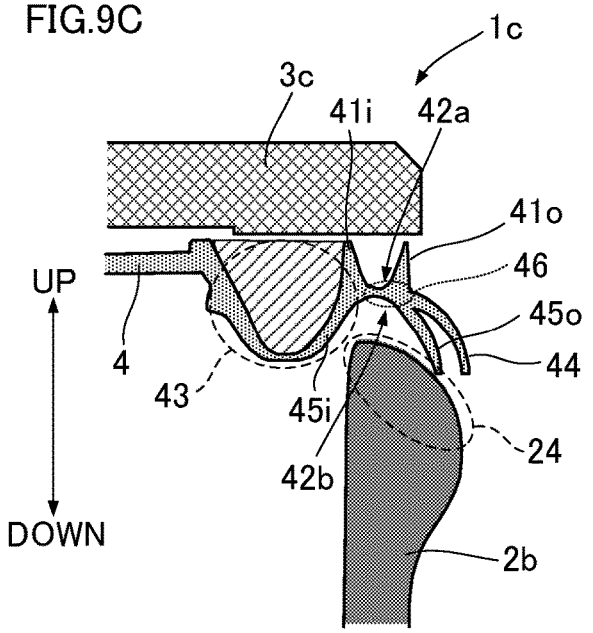
Figure 9D:
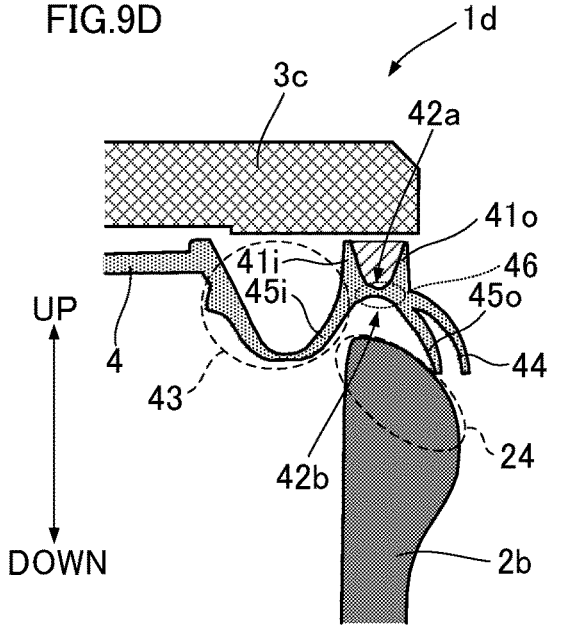

FIG. 8 shows an example of the thickness of each part of the packing 4. In the container 1 according to the embodiment, the bent portion 43 has a thickness t1=0.3 mm at the bottom, a thickness t2=0.6 mm at the top of the shared wall 45*i*, and a thickness t3=0.4 mm of the bottom 46 shared by the first concave portion 42*a* and the second concave portion 42*b*. Note that the thickness of each part of the packing 4 is not limited to those of the example shown in FIG. 8, and may be adjusted as appropriate depending on the diameter of the packing 4, the tightening torque of cap 3 at the time of packaging, the required airtightness, etc. In any case, it suffices if the first concave portion 42*a* and the second concave portion 42*b* are formed by sharing the bottom 46 on the upper surface and the lower surface of the outer edge of the packing 4, and if the bent portion 43 is formed somewhere between the center of the packing 4 and the area where the first concave portion 42*a* and the second concave portion 42*b* are formed. In addition, it suffices if the bent portion 43 bends downward in the radially outward direction and then bends upward to form the shared wall 45*i*, and the upper end of the shared wall 45*i* is continuous with the upper surface inner protrusion 41*i* of the first concave portion 42*a*.

The vertical cross-sectional shape of the first concave portion 42*a* and the second concave portion 42*b* is not limited to a V-shaped, inverted V-shaped, or U-shaped or inverted U-shaped cross-section. Similarly, the bent portion 43 is also not limited to the U-shape.

Airtightness

Next, in order to evaluate the airtightness performance of the container 1 according to the embodiment, four types of containers with sealing structures different from the sealing structure of the container 1 according to the embodiment were prepared as comparative examples. FIGS. 9A, 9B, 9C, 9D are cross-sectional views illustrating sealing structures of airtight containers prepared as these comparative examples. That which is illustrated in FIGS. 9A, 9B, 9C, 9D corresponds to the area within the circle 104 in FIG. 5A. Further, in FIGS. 9A, 9B, 9C, 9D, the cap body 3*a* and the exterior case 2*a* are omitted, and the pressing member 3*c*, the packing 4 and cup member 2*b* are shown only in cross-section. The configurations of the container body 2 and the cap body 3*a* of the containers 1*a*-1*d* according to the comparative examples is the same as that of the embodiment. A decompression test was conducted on the container 1 according to the embodiment and the containers 1*a*-1*d* according to the comparative examples shown in FIGS. 9A, 9B, 9C, 9D, in which each container (1, 1*a*-1*d*) was placed in a decompression environment after the cap 3 was attached and the opening of the container body 2 was closed, and the air pressure at which the contents in the container body 2 leaked was measured.

As shown in FIGS. 9A-9D, no circumferential lip 36 is formed on pressing members 3*c* of the containers 1*a*-1*d* according to the comparative examples. Further, although the containers 1*a*-1*d* have the same packing 4 as that of the container 1 according to the embodiment, in FIGS. 9B-9D the parts indicated by the diagonal hatching are filled with adhesive in a cured state so that they cannot be elastically deformed.

In the decompression test was performed on the container 1 according to the example and the containers 1*a*-1*d* according to the comparative examples, the container 1*a* and the container 1*d* maintained their airtightness up to an atmospheric pressure of 350 hPa. However, the contents of the container 1*b* and the container 1*c* leaked before the pressure was reduced to 350 hPa. In contrast, the container 1 according to the embodiment maintained its airtightness until the pressure was reduced to the extremely low pressure of 80 hPa. Considering that standard atmospheric pressure is 1013 hPa, although it could be said that the container 1*a* and the container 1*d* exhibited sufficient airtightness performance, the container 1 according to the embodiment proved capable of maintain airtightness at extremely low atmospheric pressures of ¼ or less that of the containers 1*a* and 1*d*.

Considering the results of decompression tests on various containers (1, 1*a*-1*d*), first, from the test results of the containers 1*a*-1*d*, it was clear that it is necessary for the bent portion 43 to be able to elastically deform in order to ensure sufficient airtightness. In other words, it was clear that it is necessary that a bent portion 43 be formed in the packing 4. From the test results of the container 1 according to the embodiment it was clear that superior airtightness can be provided by the bent portion 43 and the first concave portion 42*a* elastically deforming, and by the circumferential lip 36 of the pressing member 3*b* forcibly widening the first concave portion 42*a*.

Other Embodiments

Although the cap 3 of the container 1 according to the embodiment is composed of a cap body 3*a* and a pressing member 3*b* provided with a circumferential lip 36, alternatively the protruding lip 36 may be integrated into the inside of the top surface 31 of the cap body 3*a*. With such a configuration, the pressing member 3*b* becomes unnecessary and the number of parts to be used to configure the container 1 can be reduced. If the circumferential lip 36 is integrated into the cap body 3*a*, it is desirable that the shape of the top surface 31 of the cap body 3*a* is flat on the inside so as to fully contact the flat portion 47 of the packing 4. On the other hand, if the cap 3 is provided with the pressing member 3*b* is, it is not necessary to flatten the inside of the top surface 31, and if a structure for holding the member 3*b* is provided inside the cap body 3*a* the external shape of the cap body 3*a* can be designed more freely. In any case, whether or not to include the pressing member 3*b* can be decided as appropriate depending on the appearance of the container 1 and the like.

When the container 1 is provided with the screw-type cap 3 and the pressing member 3*b*, a slight amount of play may be provided between the outer edge of the pressing member 3*b* and the inside surface 32 of the cap body 3*a*, so that, in the process of screwing the cap body 3*a*, as friction between the circumferential lip 36 and the first concave portion 42*a* increases, the cap body 3*a* and the pressing member 3*b* rotate relatively around the axis 100 and the cap 3 can be attached to the neck 23 more smoothly.

Although the container 1 according to the embodiment is provided with the screw-type cap 3, alternatively the cap 3 attachment structure may, for example, be one in which a hook formed in the cap body 3*a* disengagingly engages a concave portion formed in the outside of the neck 23. Provided that the container 1 according to the embodiment has a sealing structure composed of the packing 4 having the first concave portion 42*a*, the second concave portion 42*b*, and the bent portion 43, and the circumferential lip 36 that is squeezed into the first concave portion 42 to widen the first concave portion 42*a*, that sealing structure may be anything that is universally applicable to any cap 3 attachment structure no matter what it is.

In the container 1, when the pressure inside the container body 2 is relatively high on the cap 3 under a reduced-pressure environment or the like, a mechanism to hold down the packing 4 that tries to be pushed upward is required. In the attachment structure of the cap 3 using the hook or the like described above, the cap 3 may become disengaged from the neck 23 if the pressure difference between the inside of the container body 2 and the outside is too great. However, the container 1 according to the above-described embodiment uses the screw-type cap 3, and therefore the state of attachment can be maintained as long as the cap body 3*a* and the like are not damaged.

Figure 10:
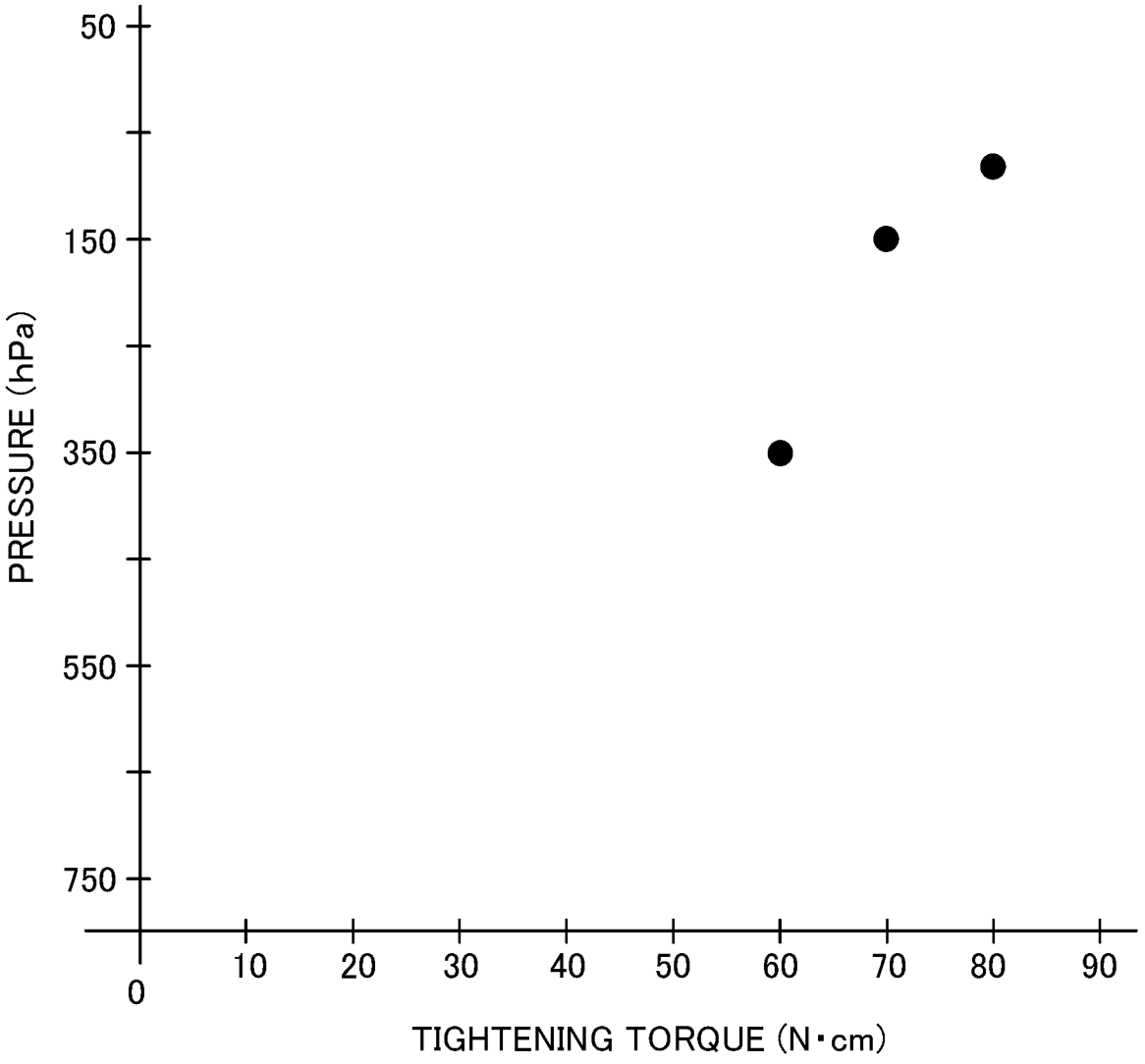
FIG. 10 is a graph illustrating the relationship between the tightening torque of the cap and the airtightness of the airtight container according to the embodiment of the present disclosure.

Furthermore, if the cap 3 is a screw-type cap, the airtightness can be adjusted according to the tightening torque. Therefore, the airtightness of the container 1 can be flexibly set according to the application without the need to change the shape of the packing 4 or the mouth 24 of the container body 2. For example, simply by preparing various container bodies 2 and cap bodies 3*a* with different screwing amounts, the pressing member 3*b* and the packing 4 can continue to be used for ordinary purposes. Therefore, when designing different containers 1, it is not necessary to change the shape of the mouth 24 of the container body 2, and as a result it is possible to hold down design costs. FIG. 10 shows the relation between tightening torque and airtightness of the cap 3 of the container 1 according to the embodiment. As is clear from FIG. 10, the airtightness increases as the tightening torque increases.

The flat portion 47 of the flexible packing 4 tries to deform upward in a reduced-pressure environment, and the pressing member 3*b* abuts on the flat portion 47 to suppress the deformation of the packing 4. However, when the pressure inside the container body 2 is much greater than the atmospheric pressure outside, a thin pressing member 3*b* may itself be deformed. Therefore, in the container 1 according to the above-described embodiment, a tubular protrusion 34 that depends from the top surface 31 is provided inside the cap body 3*a*, and as shown in FIGS. 5A-6B the lower end of the tubular protrusion 34 contacts the bottom of the central concave portion 35 in the upper surface of the pressing member 3*b* to prevent the pressing member 3*b* from bulging upward. As a result, even if the container 1 is intended for use in a place where the atmospheric pressure is extremely low, it is not necessary to increase the strength of the pressing member 3*b* by increasing its thickness.

Alternatively, the packing 4 and the cap 3 need not be separate parts, and thus, for example, a projection that supports the edge of the packing 4 may be formed around the inside surface 32 of the cap body 3*a*. Similarly, the packing 4 may be attached to the lower surface of the pressing member 3*b* by a method such as adhesion. In any case, as long as the elastic deformation of the bent portion 43, the first concave portion 42*a*, and the second concave portion 42*b* of the packing 4 is not inhibited when the pressing member 3*b* is pressed downward, the packing 4 may be either integrated into the cap 3 or it may be a separate member.

Figure 11A:
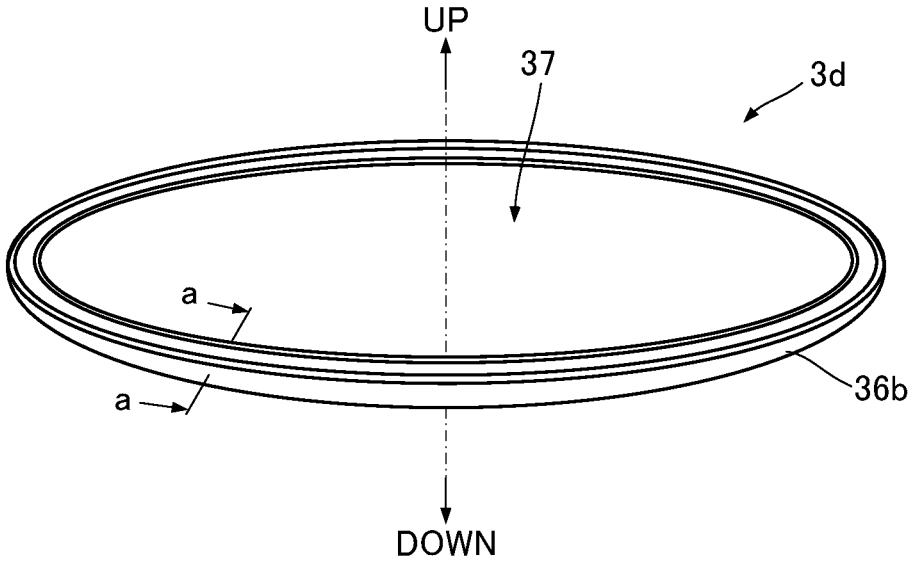
FIG. 11A is a perspective view illustrating a modified example of a pressing member that is a constituent part of the airtight container according to the embodiment of the present disclosure.
Figure 11B:
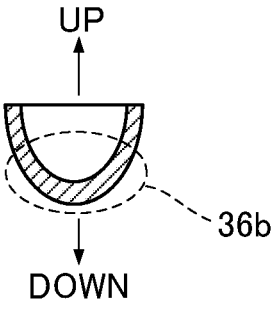
FIG. 11B is a vertical cross-sectional view of a part of the pressing member.
Figure 12A:
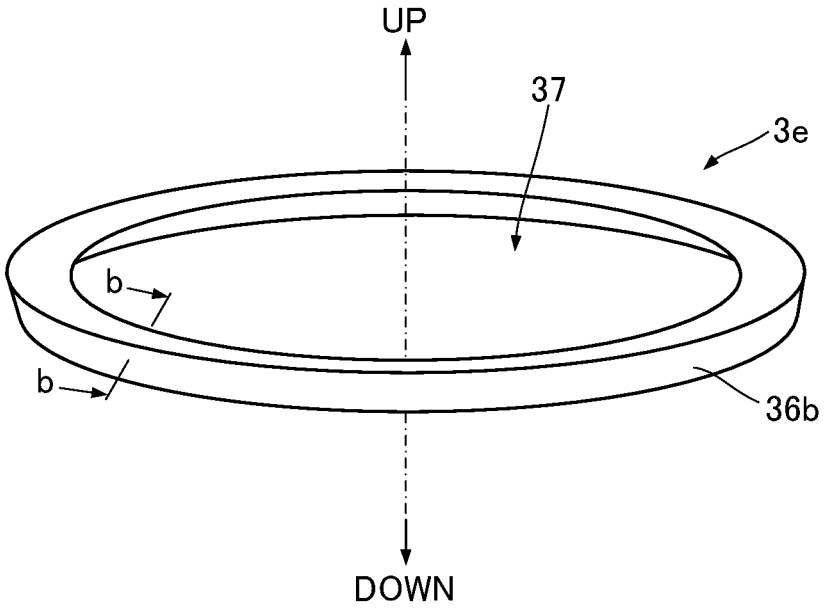
FIG. 12A is a perspective view illustrating another modified example of a pressing member that is a constituent part of the airtight container according to the embodiment of the present disclosure.
Figure 12B:
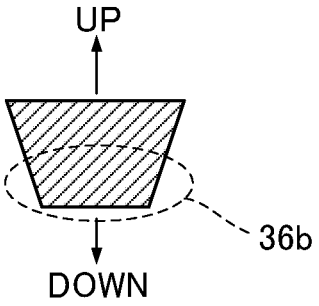
FIG. 12B is a vertical cross-sectional view of a part of the pressing member.

Instead of the planar shape, the pressing member 3*b* may be an annular shape with an open center. In addition, the planar shape of the ring-shaped pressing member 3*b* does not have to be flat; that is, the vertical cross-sectional shape may be a shape other than a rectangle. For example, if the pressing member 3*b* itself is an annular body (O-ring, torus), the planar shape is annular and the vertical cross-sectional shape is circular. Of course, even if the planar shape is annular, the vertical cross-sectional shape is not limited to a circle. FIGS. 11A-12B show examples of the pressing member 3*b*, having a center hole 37, and although the planar shape is an annular shape the vertical cross-section is not a circle. In a pressing member 3*d* shown in FIGS. 11A-11B, although the planar shape is annular as shown in FIG. 11A, as shown in FIG. 11B, the vertical cross-section (cross-section along the perspective plane a-a in FIG. 11A) is U-shaped. In addition, in the pressing member 3*e* shown in FIG. 12A-12B, although the planar shape is annular as shown in FIG. 12A, as shown in FIG. 12B the shape of the vertical cross-section (cross-section along the perspective plane b-b in FIG. 12A) is an inverted trapezoid with the bottom as the upper base. It suffices if the pressing members (3*b*, 3*d*, 3*e*) have flattened upper and lower surfaces regardless of the presence or absence of the center hole 37 and the vertical cross-sectional shape.

It is to be noted that the shape of the pressing member (3*d*, 3*e*) shown in FIGS. 11A-12B itself functions in the same manner as the circumferential lip 36. In any case, it suffices if the bottom edge of the pressing member (3*b*, 3*d*, 3*e*) has a portion (36, 36*b*) that is inserted into the first concave portion 42*a*, and that the portion (36, 36*b*) has a vertical cross-sectional shape that narrows toward the lower end, that is, if the bottom of the pressing member (3*b*, 3*d*, 3*e*) has a portion having a downwardly convex shape. Moreover, the upper end of this portion (36, 36*b*) does not necessarily have to be wider than the lower end. In the pressing member (3*b*, 3*d*, 3*e*), as for the vertical cross-sectional shape of the circumferential lip 36 of the planar pressing member 3*b*, and the vertical cross-sectional shape of the portion 36*b* having the same function as the circumferential lip 36 of the annular pressing member 3*b*, polygons of five sides or more and rhombuses with the lower end side as the top are also conceivable. In short, it suffices if the portion (36,36*b*) that is pressed into the first concave by the force of the pressing member (3*b*, 3*d*, 3*e*) being pressed downward by the cap body 3*a* is configured to spread apart the first concave portion 42*a* of the packing 4 radially inward and outward so that the second concave portion 42*b* is pressed firmly against the mouth 24. Note that if the planar shape of the pressing member 3*b* is annular, and the tubular protrusion 34 is formed in the cap body 3*a*, as a matter of course the lower end of the tubular protrusion 34 comes into contact with a position on the upper surface of the pressing member 3*b* where the center hole 37 is not formed.

In the container 1 according to the above-described embodiment, the container body 2 and cap 3 have been configured to be disposed coaxial with the longitudinal axis 100 when the cap 3 is attached to the container body 2. Alternatively, provided that the neck 23 is cylindrical, the neck 23 it may be formed so as to project in any appropriate direction such as an oblique direction with respect to the container body 2, so long as the longitudinal axis 100 direction of the cap 3 attached to the neck 23 is the vertical direction. Further, the shape of the body portion 22 of the container body 2 is not limited to that of a bowl, and may be any shape such as a square cylinder, a cylinder, or a sphere. Similarly, the external shape of the cap body 3*a* is not limited to that of a cylinder.

Depending on the external design of the container 1 or the design of the attachment structure of the cap 3, the planar shape of the opening (mouth 24) of the container body 2 does not have to be circular, and the planar shape of the pressing member 3*b* and the packing 4 may be suitably varied according to the shape of the mouth 24. For example, if the planar shape of the mouth 24 is a rectangle, then the outer shape of the packing 4 is also a rectangle. In any case, when the shape of the opening of the container body 2 is the same, it is clear that the airtightness of the container 1 can be enhanced by utilizing the pressing member 3*b* having the circumferential lip 36 and the packing 4 having the first concave portion 42*a*, the second concave portion 42*b*, and the bent portion 43.

Of course, if the shape of the opening of the container body 2 is circular, the planar shape of the pressing member 3*b* is circular or annular, and the planar shape of the packing 4 is circular, then the internal pressure inside the container body 2 is uniformly applied to the packing 4 from the opening and the circumferential lip 36 of the pressing member 3*b* can uniformly deform the first concave portion 42*a* of the packing 4 against this internal pressure. As a result, the airtightness of the container body 2 can be ensured even in extremely harsh reduced-pressure environments.

In the above-described embodiment, the vertical cross-sectional shape of the circumferential lip 36 of the pressing member 3*b* is a V, wide at the top and gradually narrowing toward the bottom. However, the protruding lip 36 may be any shape that, when pressed into the first concave portion 42*a*, spreads apart the upper surface inner protrusion 41*i* and the upper surface outer protrusion 41*o* forming the first concave portion 42*a* radially inward and outward. The vertical cross-sectional shape of the circumferential lip 36 may be, for example, a U or an inverted trapezoid. Alternatively, the circumferential lip 36 may have an O-ring-like appearance, and therefore may be circular or ring-shaped in vertical cross-section.

In the container 1 according to the above-described embodiment, the exterior case 2*a*, the cup member 2*b*, the cap body 3*a*, and the pressing member 3*b* are molded plastic products. Alternatively, however, any or all of these members (2*a*, 2*b*, 3*a*, 3*b*) are not limited to plastic, and may be made metal, glass, or some other material. In addition, the exterior case 2*a*, cup member 2*b*, cap body 3*a*, and pressing member 3*b*, for example, may be composed of different materials depending on the part.

Further, the pressing member 3*b* may be made of an elastic material. The pressing member 3*b* may, for example, be composed of a material harder than the material of the packing 4, so long as it can press the packing 4 and cause the packing 4 to deform. Moreover, the pressing member 3*b* should be designed so that, if subjected to a pressing force, it can return to its original shape once that force is released.

LIST OF REFERENCE NUMBERS

1,1*a*-1*d* Airtight container
2 Container body
2*a* Exterior case
2*b* Cup member
3 Cap
3*a* Cap body
3*b*-3*e* Pressing member
4 Packing
23 Neck
24 Mouth
25 Male screw thread
33 Female screw thread
34 Tubular protrusion
36 Circumferential lip
36*b* Portion of the annular pressing member having a convex lower end side
37 Center hole
41*i* Upper surface inner protrusion
41*o* Upper surface outer protrusion
42*a* First concave portion
42*b* Second concave portion

43 Bent portion
45*i* Shared wall
45*o* Lower surface outer protrusion
47 Flat portion

What is claimed is:

1. An airtight container comprising:

a container body provided with a cylindrical neck having an opening at one end;

a cap that is removably attachable to the neck; and a packing that seals the opening, wherein with a longitudinal axis of the cylindrical neck as the vertical direction, the opening opens upward, a mouth of the opening is a curved line that is upwardly convex in a vertical cross-section along a plane including the vertical direction, the packing has a flattened planar shape in which are formed a groove-shaped first concave portion coaxial with the longitudinal axis formed in the upper surface of the outer rim of the packing, a groove-shaped second concave portion coaxial with the longitudinal axis formed in the lower surface of the outer rim of the packing that shares a bottom with the first concave portion, and a downwardly convex bent portion bent so as to form an upwardly open groove and formed at a position radially outboard of a center of the packing and radially inboard of the first concave portion and the second concave portion, an outer edge of the bent portion shares a shared side wall with an inward facing edge of the first concave portion, and the shared side wall has a top that is continuous with a side wall on the inward facing edge of the first concave portion and generates stress that widens the first concave portion to generate stress that narrows the second concave portion, an inside of the cap has a portion formed therein having a convex shape on a lower end side thereof and disposed coaxial with the longitudinal axis, the lower end side being formed in a shape of decreasing width toward a tip thereof, wherein, when the cap is attached to the neck in a state in which the inner surface of the second concave portion is contacted against the mouth of the opening of the neck, the portion having a convex shape on a lower end side of the cap is inserted into the first concave portion and widens the first concave portion.

2. The airtight container according to claim 1, wherein the cap is configured by a hollow cylindrical cap body that opens downward and a pressing member that is circular or annular in planar shape disposed within the cap body and arranged substantially at right angles to the cylindrical axis of the cap body, and the pressing member has a protruding circumferential lip having the convex shape on a lower end side around the lower rim thereof.

3. The airtight container according to claim 1, wherein the cap is configured by a hollow cylindrical cap body that opens downward and a pressing member annular in planar shape disposed within the cap body and arranged substantially at right angles to the cylindrical axis of the cap body, and the pressing member has a lower end side that is the convex shape in vertical cross-section along a plane including the vertical direction.

4. The airtight container according to claim 2, wherein the cap body is provided with a tubular protrusion portion that depends vertically downward from the inside top surface of the cap body, and the lower end of the tubular protrusion abuts on the upper surface of the pressing member while the cap is attached and presses the pressing member downward.

5. The airtight container according to claim 1, wherein the cap is a screw-type cap that screws into a male screw thread formed on the outside of the neck.

* * * * *